US005389901A

United States Patent [19]

Sterns et al.

[11] Patent Number: 5,389,901

[45] Date of Patent: Feb. 14, 1995

[54] MICROWAVE AMPLITUDE EQUALIZER CIRCUIT

[75] Inventors: William G. Sterns, West Hills; Ching F. Cho, Tujunga, both of Calif.

[73] Assignee: ITT Corporation, New York, N.Y.

[21] Appl. No.: 36,037

[22] Filed: Mar. 23, 1993

[51] Int. Cl.[6] ..... H01P 5/12; H01P 5/18

[52] U.S. Cl. ..... 333/109; 333/114; 333/28 R

[58] Field of Search ..... 333/28 R, 109, 114, 333/115, 116

[56] References Cited

U.S. PATENT DOCUMENTS

| | | | |
|---|---|---|---|
| 4,268,804 | 5/1981 | Spinner et al. | 333/125 |
| 4,814,780 | 3/1989 | Sterns et al. | 343/756 |
| 5,235,296 | 8/1993 | Saka | 333/109 |

FOREIGN PATENT DOCUMENTS

| | | | |
|---|---|---|---|
| 0294103 | 11/1988 | Japan . | |
| 1418831 | 8/1988 | U.S.S.R. | 333/109 |

OTHER PUBLICATIONS

"New Tunable Branch Line Coupler" *Applied Microwave* by A. M. Khilla Spring 91, pp. 98–112.

"Resistive 4–port directional coupler" Jenkins et al. *IEEE Proc.* vol. 129, Pt. H No. 3, Jun. 1982, pp. 94–98.

*Primary Examiner*—Robert J. Pascal

*Assistant Examiner*—Darios Gambino

*Attorney, Agent, or Firm*—Arthur L. Plevy; Patrick M. Hogan

[57] ABSTRACT

A modified branch line coupler amplitude equalizer circuit employing cross arms and branch lines of varying lengths and impedances to minimize the return loss of the circuit.

17 Claims, 13 Drawing Sheets

| TRACE | Z/Zo | LENGTH AT F/Fo = 1.00 (DEGREES) |
|---|---|---|
| 15,16 | 1.000 | N/A |
| 20,21,22,23 | 1.192 | 98.6 |
| 17,18 | 0.968 | 107.4 |
| 19 | 1.592 | 65.4 |

ALL TRACES $Z/Z_O = 1.00$
LENGTH AT $F/F_O = 1, 90°$

| TRACE | $Z/Z_o$ | LENGTH AT $F/F_o = 1.00$ (DEGREES) |
|---|---|---|
| 15,16 | 1.000 | N/A |
| 20,21,22,23 | 1.192 | 98.6 |
| 17,18 | 0.968 | 107.4 |
| 19 | 1.592 | 65.4 |

| TRACE | $Z_o$ | LENGTH AT 3.2 $GH_z$ (DEGREES) | MICROSTRIP LINE WIDTH (in.) |
|---|---|---|---|
| 12,13,15,16 | 50.0 | N/A | .094 |
| 20,21,22,23 | 59.6 | 98.6 | .081 |
| 17,18 | 48.4 | 107.4 | .109 |
| 19 | 79.6 | 65.4 | .060 |

| TRACE | Z/Zo | LENGTH AT $F/F_o = 1.00$ (DEGREES) |
|---|---|---|
| 15,16 | 1.000 | N/A |
| 20,21,22,23 | 1.395 | 79.8 |
| 17,18 | 0.905 | 64.8 |
| 19 | 2.600 | 127.2 |

| TRACE | Z/Zo | LENGTH AT F/Fo = 1.00 (DEGREES) |
|---|---|---|
| 45,46 | 1.000 | NA |
| 51,52,55,56 | 1.324 | 272.7 |
| 53,54 | 1.468 | 70.3 |
| 47,48 | 1.195 | 83.6 |
| 49,50 | 2.298 | 108.3 |

MICROWAVE AMPLITUDE EQUALIZER CIRCUIT

FIELD OF THE INVENTION

This invention relates to equalizer circuits, and more specifically to simple microwave circuits that are particularly useful in low or high power systems with modest bandwidths, such as radar and communications.

BACKGROUND OF THE INVENTION

The output signal levels of most RF circuits, particularly active circuits, have a relatively smooth variation over the operational frequency band, whereas subsequent circuits, or amplifier stages, often need, or require, a nearly constant input signal level. For example, the gain of high power RF transistors generally varies over the frequency band. This can cause problems in a multi-stage RF amplifier where a first power transistor drives a second power transistor. If the transistor to be driven can only operate within certain upper and lower limits of drive power, and the output power of the driver transistor falls outside of these limits, then the driven amplifier will not function properly over the desired frequency band. A passive equalizer circuit with low input and output return loss can remedy this problem by attenuating the output power of the driver transistor over a portion of the operating band, while providing less attenuation over the remainder of the band, including a frequency with near zero loss.

Amplitude equalizers can be designed to operate over wide band-widths at low power levels. See D. J. Mellor, *On the Design of Matched Equalizer of Prescribed Gain versus Frequency Profiles*, MWSYM 77, at pp. 308–311; W. H. Ku et al., *Microwave Octaveband GaAs FET Amplifiers*, IEEE Int. Microwave Syrup. Dig. Tech. Papers, at pp. 69–72 (1975).

These circuits are relatively complex because of the wide bandwidths involved; the fact that their power capacity is insufficient to be used with microwave power transistors is not important, for the circuits are satisfactory for their intended use.

By contrast, high power amplifiers (>5 watts) generally operate over restricted bandwidth (15% or less). Equalizers for these amplifiers must be capable of passing and dissipating considerable amounts of power, must have very well matched input and output impedances, and must not reduce the minimum power of the amplifier.

It is, therefore, an object of this invention to provide a simple equalizing circuits, consisting of one basic element, that can handle up to kilowatts of peak power and many watts of average power that has well matched input and output impedances, and can have zero loss at some point(s) in the operating frequency band.

SUMMARY OF THE INVENTION

An amplitude equalizer circuit in the form of a branch line directional coupler, wherein the characteristic impedance and electrical lengths of the coupler elements are selected to provide a desired change in insertion loss with frequency, while maintaining low input and output return losses. The circuits can be designed to have a positive or negative insertion loss slope with frequency, and, or, to have a zero slope at some frequency within the operating band.

DETAILED DESCRIPTION OF THE FIGURES

Figure 1:
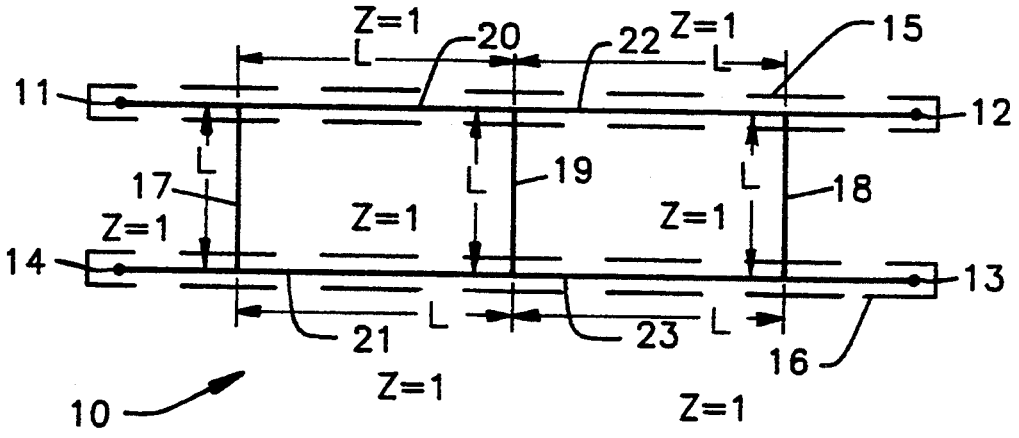
(PRIOR ART) FIG. 1
FIG. 1 shows a circuit diagram of a conventional 0 dB (cross-over) branch line directional coupler that could be considered to be a prior art equalizer circuit.

Referring to FIG. 1, there is shown a circuit diagram of a conventional prior art 0 dB (cross-over) branch line coupler, circuit 10. See J. Reed et al., *A Method Of Analysis Of Symmetrical Four-Port Networks*, Vol. MTT-4, pp. 246–252, October 1956. The circuit of FIG. 1 was described in the above-noted article as a cross-over coupler where all power entering port 11 is transferred to port 13 at the frequency where the line lengths L are a quarter wavelength long. The circuit 10 of FIG. 1 has a first port 11, a second port 12, a third port 13 and a fourth port 14. Port 11 is the input port of the circuit 10 and port 13 is the output port of the circuit 10. Ports 12 and 14 are normally terminated by some loads that absorb the incident power at port 11 that is not delivered to port 13, or reflected back into port 11. This circuit could be used as an amplitude equalizer if the high return loss could be tolerated.

Port 11 and port 12 form the respective ends of a first branch line 15, and ports 13 and 14 form the respective ends of a second branch line 16. Branch lines 15 and 16 are parallel to one another. Line 15 and line 16 are coupled together across port 11 and port 14 by cross arms 17. Line 15 and line 16 are also coupled together across port 12 and port 13 by cross arm 18. Cross arm 17 and cross arm 18 are parallel to one another and are perpendicular to lines 15 and 16. Line 15 and line 16 are also coupled together by cross arm 18 which is parallel to and positioned between cross arms 17 and 18. Cross arms 17 and 19 are separated by line segment 20 of line 15 and by line segment 21 of line 16. Cross arms 19 and 18 are separated by line segment 22 of line 15 by line segment 23 of line 16. The circuit 10 is completely symmetrical about the center line 19 in both the vertical and horizontal planes. An electrical length L of one wavelength (L=1) corresponds to 360° and an electrical length L of ¼wavelengths (L=¼) corresponds to 90°. As indicated, all of the power entering port 11 of the circuit 10 is transferred to port 13 at the frequency where the line lengths L of cross arms 17, 18 and 19 and of line segments 20, 21, 22 and 23 are a quarter wave long. As one departs from this frequency the isolation and return loss increase causing the output power to drop. The impedance of cross arms 17, 18 and 19 and of line segments 20, 21, 22 and 23 is (Z=1), where this number is normalized characteristic impedance of the input and output transmission lines.

Figure 2A:
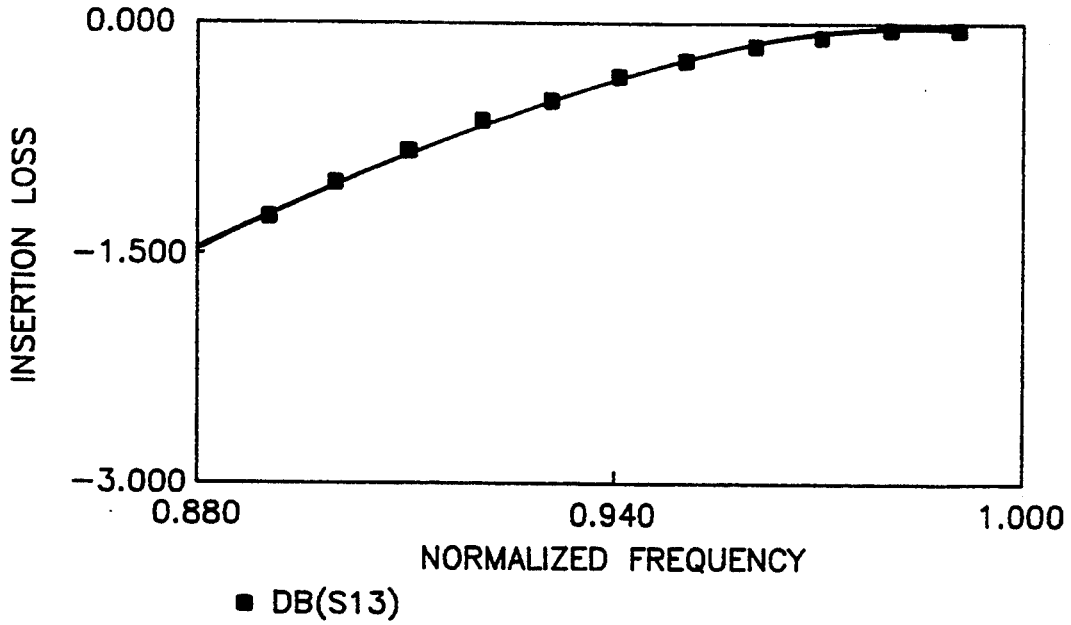
FIG. 2A shows a plot of the insertion loss, $S_{13}$, for the circuit of FIG. 1.
Figure 2B:
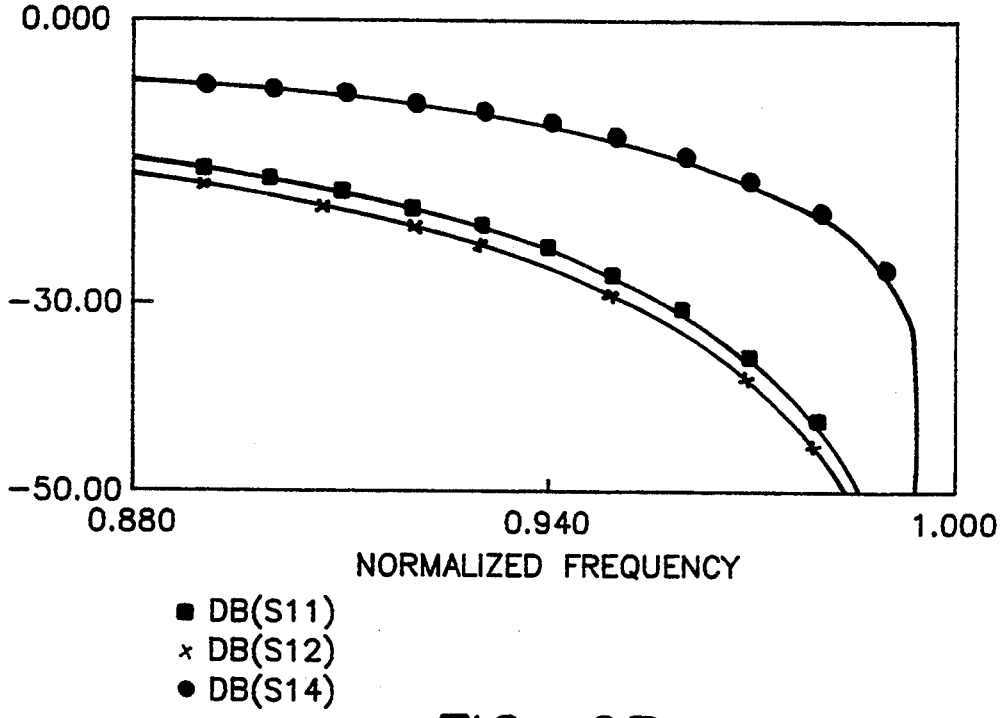
FIG. 2B shows a plot of the return loss, $S_{11}$, and the relative power delivered to the external loads, $S_{12}$ and $S_{14}$ for the circuit of FIG. 1.

Given, for example, a driver transistor providing optimal drive power to the next stage in an amplifier at 3.2 GHz. and having output power which increases approximately linearly with decreasing frequency. Then to reduce the power variation of this transistor as a function of frequency the circuit 10 should have minimal insertion loss at 3.2 GHz. with the loss increasing with decreasing frequency. FIGS. 2A and 2B show the performance of the circuit 10 where the line lengths of the cross arms 17, 18 and 19 and of the line segments 20, 21, 22 and 23 are a quarter wave long at 3.2 GHz. FIG. 2A is a plot showing the insertion loss (coupling) for the circuit 10, the power out of port 13 relative to the power into port 11, as a function of frequency. FIG. 2B is a plot showing the return loss $S_{11}$, and the power delivered to the loads at ports 12 and 14, $S_{12}$ and $S_{14}$ for the circuit 10. As seen in FIG. 2A, the insertion loss of the circuit 10 increases from −0.1 dB at 3.2 GHz to −1.6 dB at 2.8 GHz, but the return loss of the circuit 10 degrades significantly as the frequency varies from 3.2 GHz to 2.8 GHz. This can be seen in FIG. 2B where the return loss is about −14 dB at 2.8 GHz.

Such high return loss is undesirable. In the case of multistage amplifier circuits, particularly high power microwave transistor amplifiers, high return loss at either the input or output ports of the amplifier can result in unstable performance, even oscillation, of the circuit.

Figure 3:
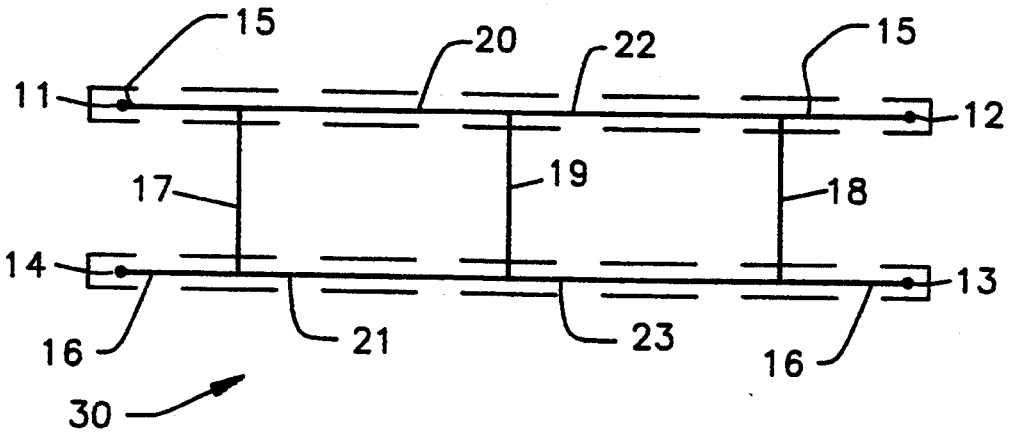
FIG. 3 shows a circuit diagram of a first embodiment of an equalizer circuit according to the present invention.

Referring to FIG. 3, there is shown a circuit diagram of the Microwave Amplitude Equalizer Circuit 30 according to the present invention which overcomes the significant return loss problems associated with conventional branch line cross-over coupler circuits by allowing the segments of the coupler to have varying electrical lengths and impedances. The circuit 30 of FIG. 3 is similar in appearance and in structure to the prior art circuit 10 of FIG. 1. Accordingly, numerals used in FIG. 1 are employed in FIG. 3 to denote similar parts. The circuit 30 overcomes the return loss problems associated with circuit 10 by allowing the electrical length of cross arm 18 to differ from arms 17 and 19, and to not be restricted to 90°, and allowing arms 20, 21, 22 and 23 to not be restricted to 90°, and by allowing the impedance of all arms to be different from 1.0. The impedances and electrical lengths of the arms are shown in FIG. 3. (It is noted that the arm lengths and impedances are not unique to give the particular change in attenuation with frequency. The values listed were obtained by a computer program that optimized all parameters of interest.)

Figure 4A:
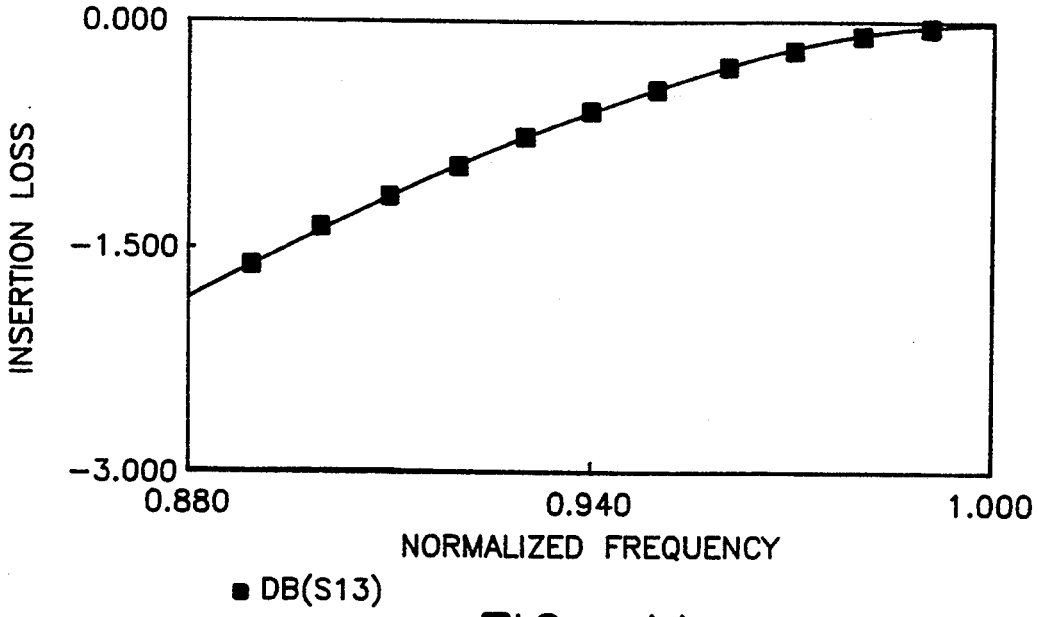
FIG. 4A shows a plot of the insertion loss, $S_{13}$, for the circuit of FIG. 3.
Figure 4B:
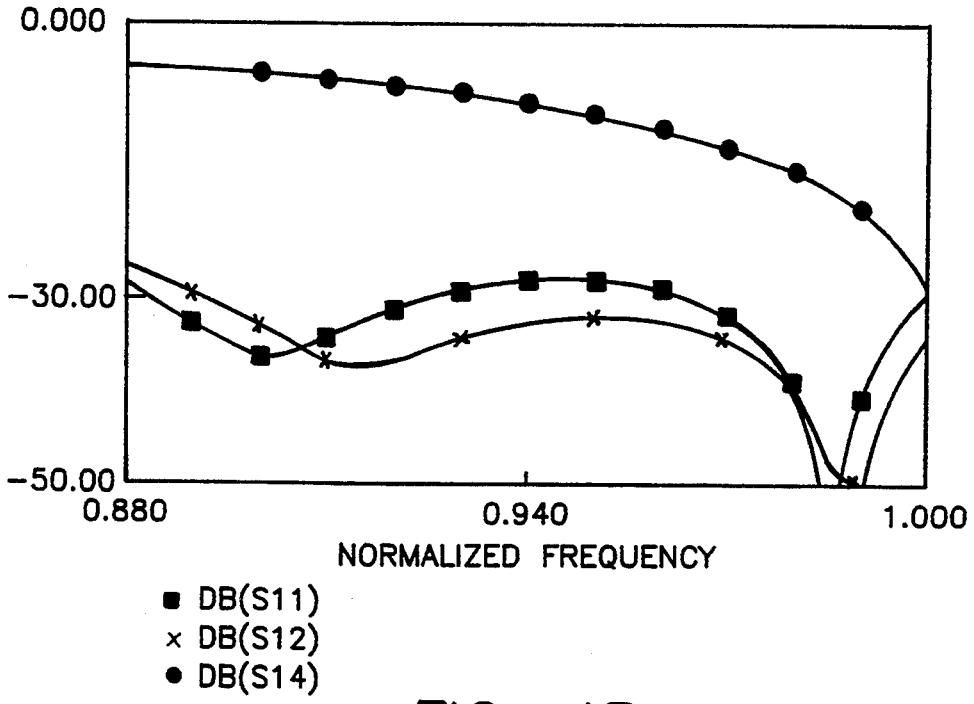
FIG. 4B shows a plot of the return loss, $S_{11}$, and $S_{12}$, and $S_{14}$ for the circuit of FIG. 3.

The calculated performance of the circuit 30 of FIG. 3 is shown in FIGS. 4A and 4B. FIG. 4A is a plot of power in dB versus frequency, showing the power out of port 13 relative to the power input at port 11. FIG. 4B shows the variation of the return loss and the power delivered to the loads, $S_{11}$, $S_{12}$, and $S_{14}$ as a function of frequency. It is seen that while the insertion loss of the circuits 10 and 30 shown in FIGS. 1 and 3, respectively, are proximately the same, the return loss of the circuit 30 shown in FIG. 3 is better than 28 dB and over a 13% bandwidth (the midband frequency ±6.5%), and is thus superior to the return loss of the circuit 10 shown in FIG. 1.

Figure 5:
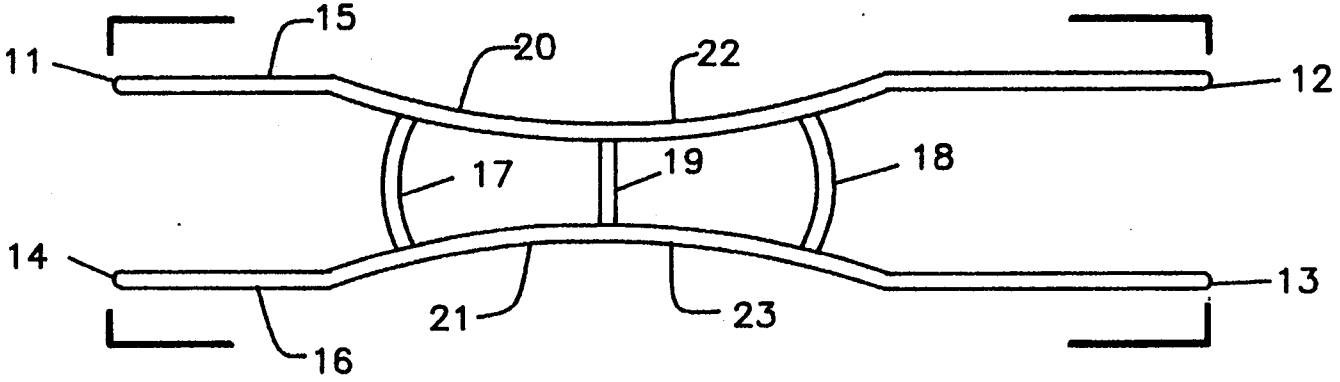
FIG. 5 shows an S Band micro-strip design of the circuit of FIG. 3 etched on 0.031 inch thick 5880 DUROID material.
Figure 6B:
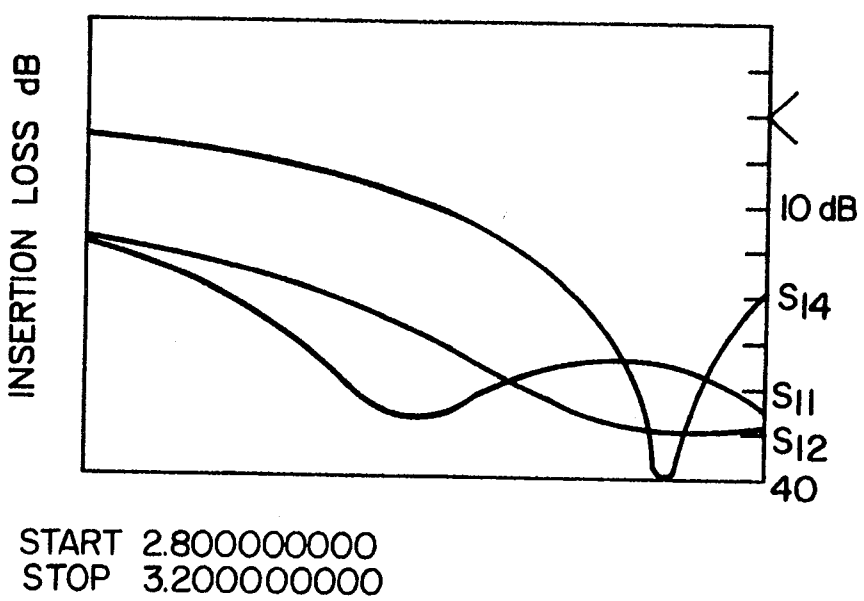
FIG. 6B shows a plot of the measured return loss, $S_{11}$, and $S_{12}$ and $S_{14}$ of the circuit of FIG. 5.
Figure 6A:
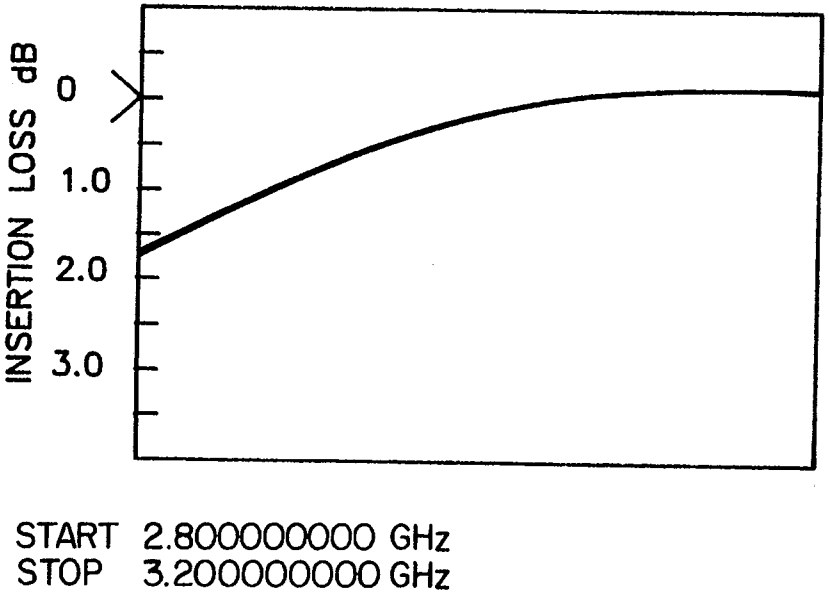
FIG. 6A shows a plot of the measured insertion loss, $S_{13}$, of the circuit of FIG. 5.

FIG. 5 shows the branch line equalizer circuit 30 shown in FIG. 3, as an S Band microstrip circuit on 0.031 5880 DUROID material. Numerals used in FIG. 3 are employed in FIG. 5 to denote identical parts. The performance of the circuit 30 of FIG. 5 is shown in FIGS. 6A and 6B. FIG. 6A is a plot of power in dB versus frequency in GHz., showing the power out of port 13 relative to the power input at port 11. FIG. 6B shows the variation in return loss and the power delivered to the loads, $S_{11}$, $S_{12}$, and $S_{14}$ as a function of frequency. This measured performance is almost identical to the theoretical values. The equalizer circuit 30 can also be designed such that its insertion loss increases with increasing frequency. To realize this in the case of a circuit having the three cross arms 17, 18 and 19, the electrical length of the center cross arm 19 will be longer than that of the outer cross arms 17 and 18.

Figure 7:
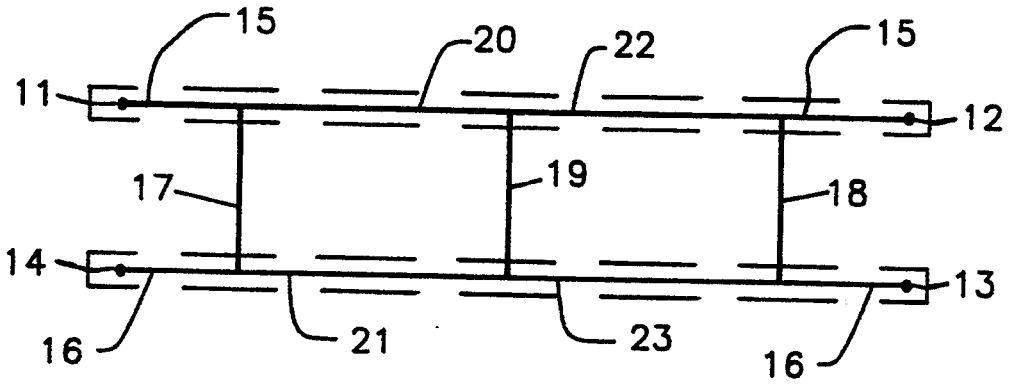
FIG. 7 shows a circuit diagram of a second embodiment of an equalizer circuit according to the present invention.
Figure 8A:
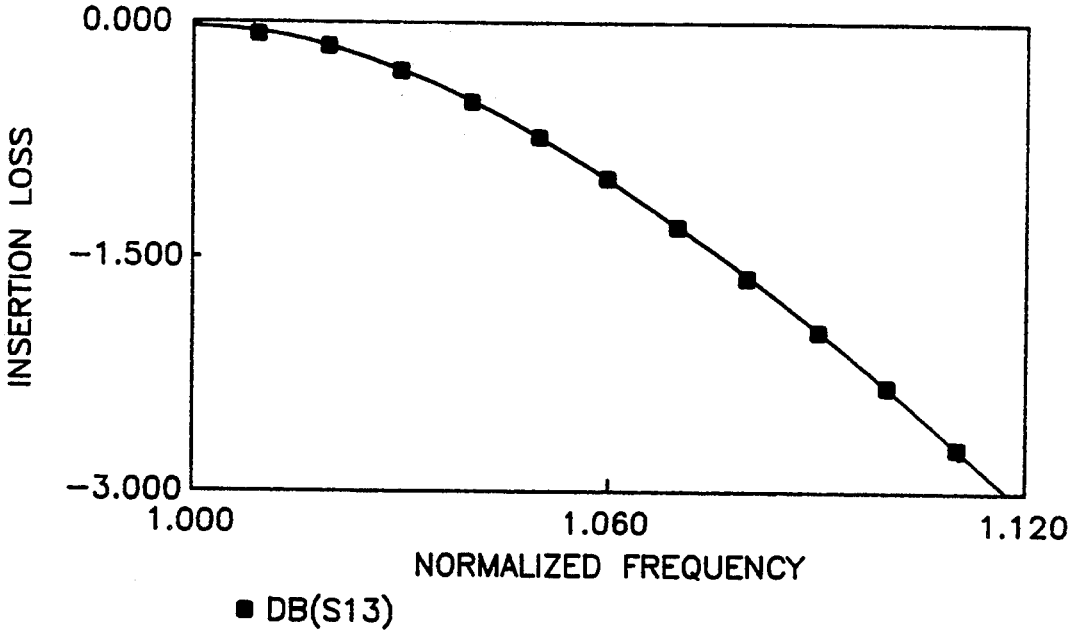
FIG. 8A shows a plot of the insertion loss, $S_{13}$, for the circuit of FIG. 7.
Figure 8B:
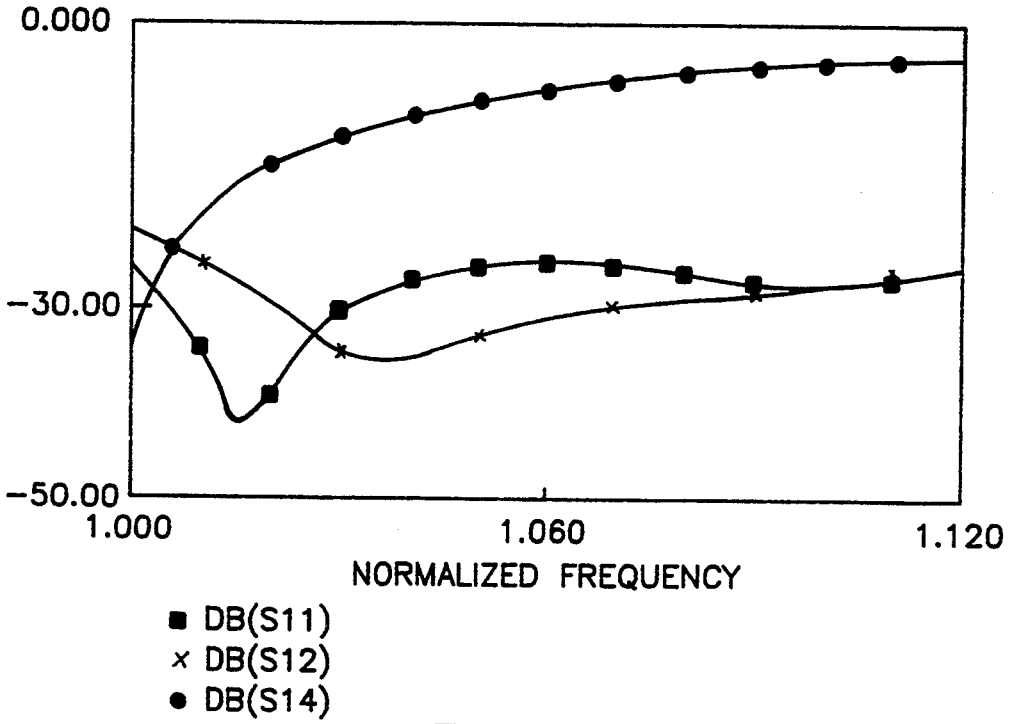
FIG. 8B shows a plot of the return loss, $S_{11}$, and $S_{12}$ and $S_{14}$ for the circuit of FIG. 7.

Referring to FIG. 7, there is shown a circuit diagram of an equalizer circuit 40 which is an alternative embodiment of the equalizer circuit which is the object of the present invention. In this case, the arm lengths and impedances are selected to achieve increasing insertion loss with frequency. The lengths and impedances values are shown in FIG. 7. The performance of this circuit is shown in FIGS. 8A and 8B.

Figure 9:
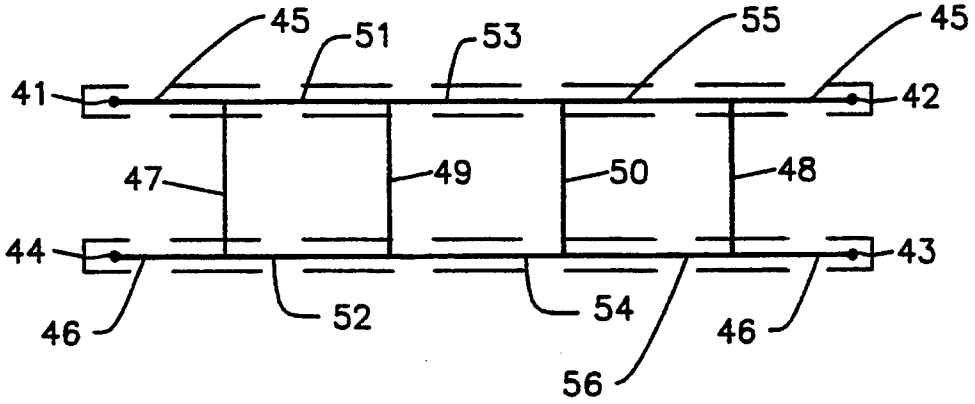
FIG. 9 shows a circuit diagram of a third embodiment of an equalizer circuit according to the present invention.
Figure 10A:
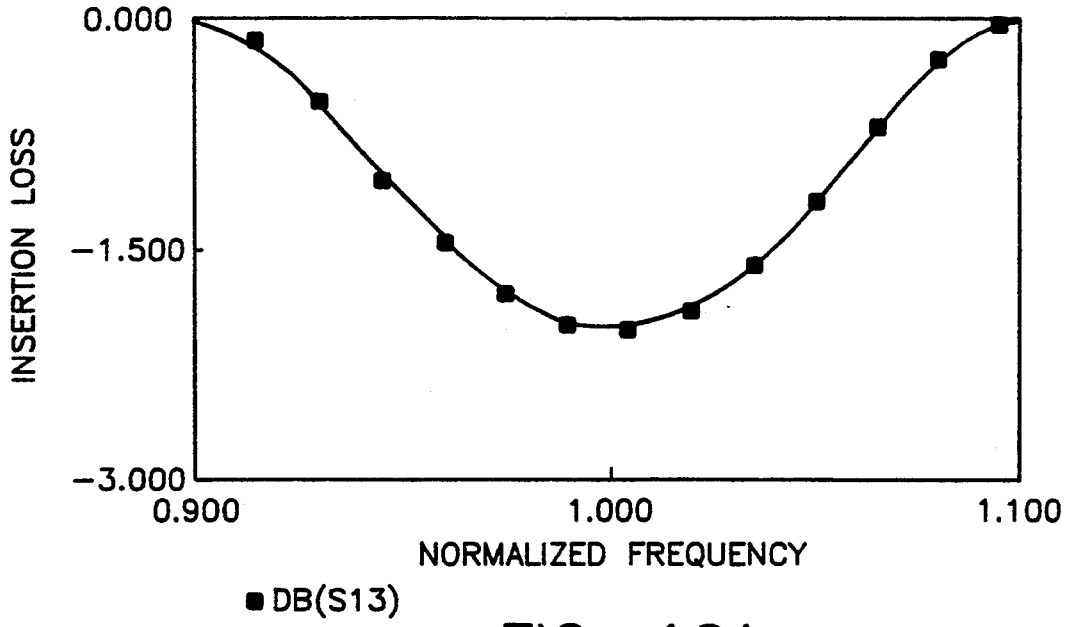
FIG. 10A shows a plot of the insertion loss, $S_{13}$, for the circuit of FIG. 9.
Figure 10B:
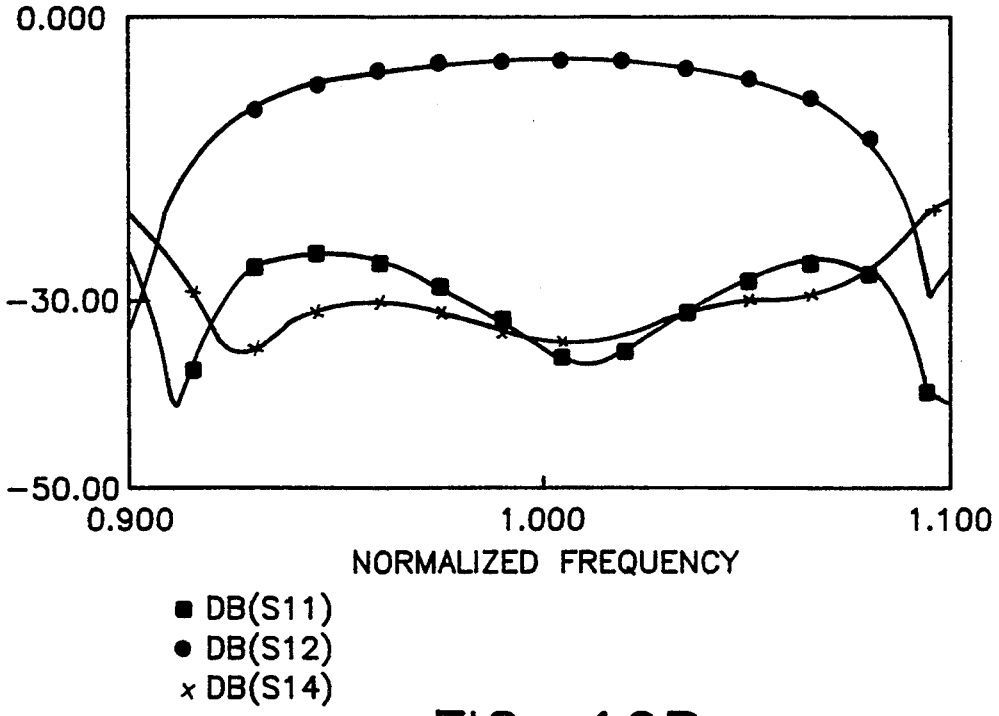
FIG. 10B shows a plot of the return loss, $S_{11}$, and $S_{12}$ and $S_{14}$ for the circuit of FIG. 9.

FIG. 9 shows a third embodiment of an equalizer circuit in accord with the present invention. This circuit would equalize, or flatten, the output power of an amplifier wherein the power output varied symmetrically with frequency. The performance of the circuit of FIG. 9 is shown in FIGS. 10A and 10B. More elements are required in this circuit than in those previously described in order to achieve three points that have zero attenuation slope with frequency. The line lengths and impedance values for the various arms are shown in FIG. 9.

All of the previously described circuits showed a specific variation in insertion loss over the selected frequency band. The amount of attenuation change can be controlled by proper selection of the line lengths and impedance levels.

Figure 11A:
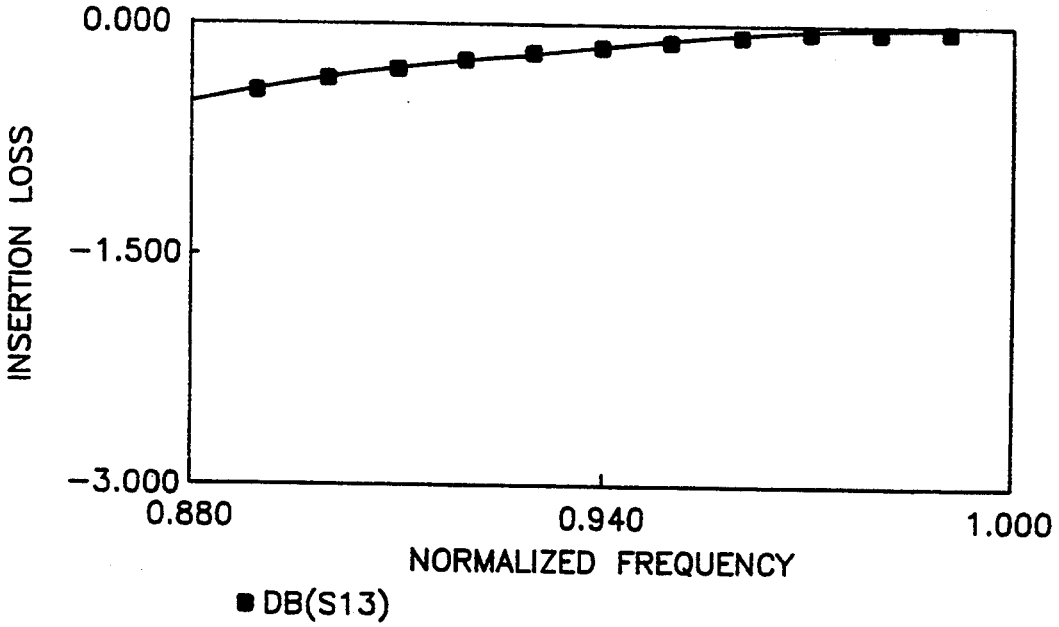
FIGS. 11A and 11B shows the performance of a circuit similar to FIG. 3 wherein the attenuation vs. frequency slope is reduced.
Figure 11B:
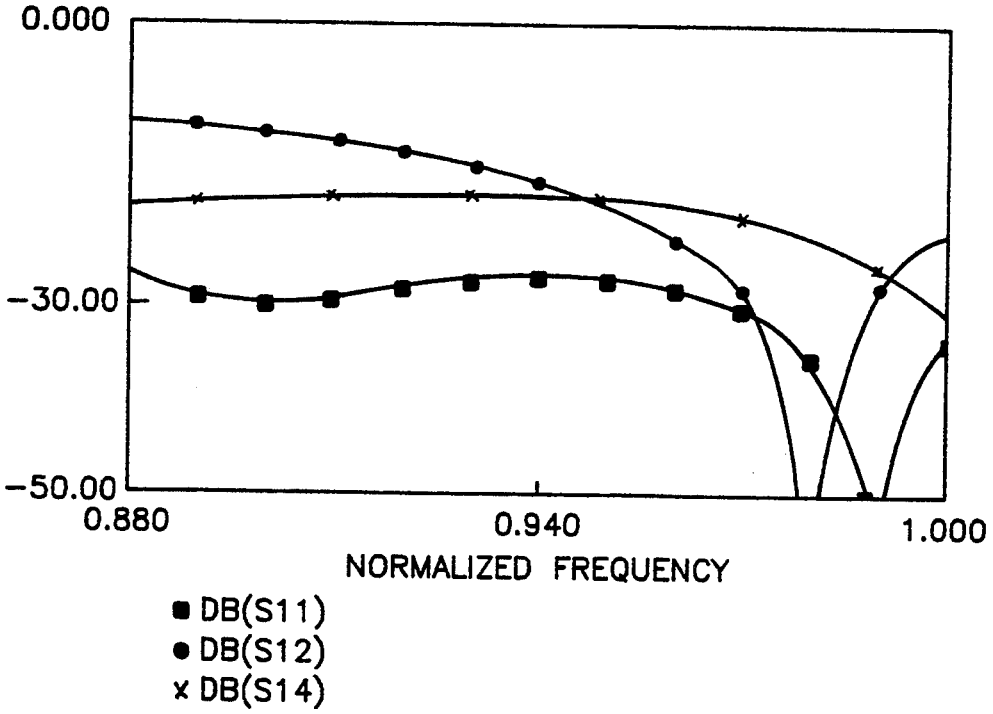

FIG. 11A and 11B shows the performance of a circuit similar to FIG. 3, wherein the attenuation change is reduced.

Figure 12A:
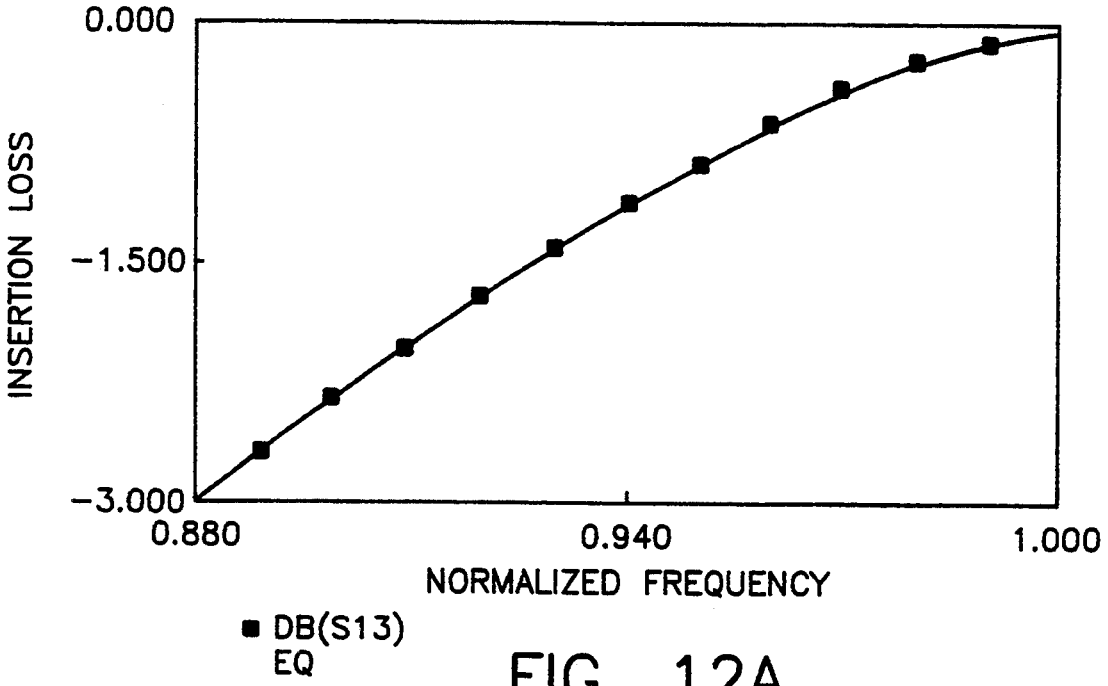
FIGS. 12A and 12B shows the performance of a circuits similar to FIG. 3 wherein the attenuation vs. frequency slope is increased.
Figure 12B:
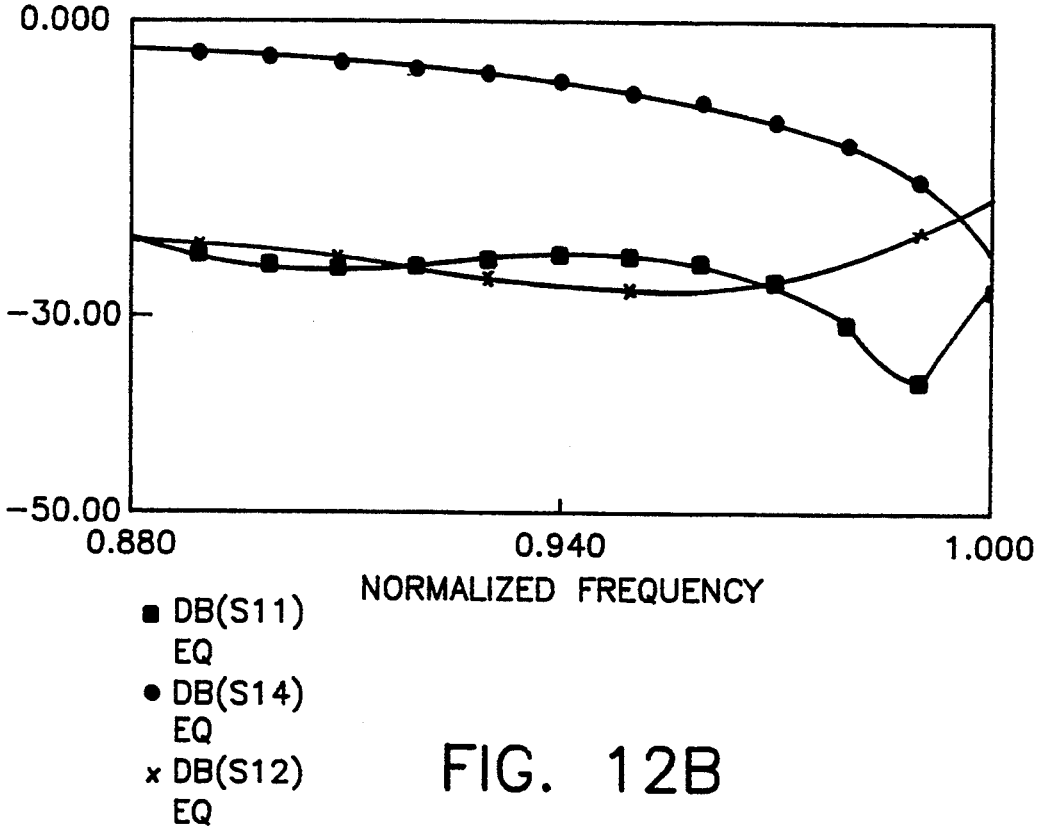

FIG. 12A and 12B shows the performance of a circuit similar to FIG. 3, wherein the attenuation change is increased.

Figure 13A:
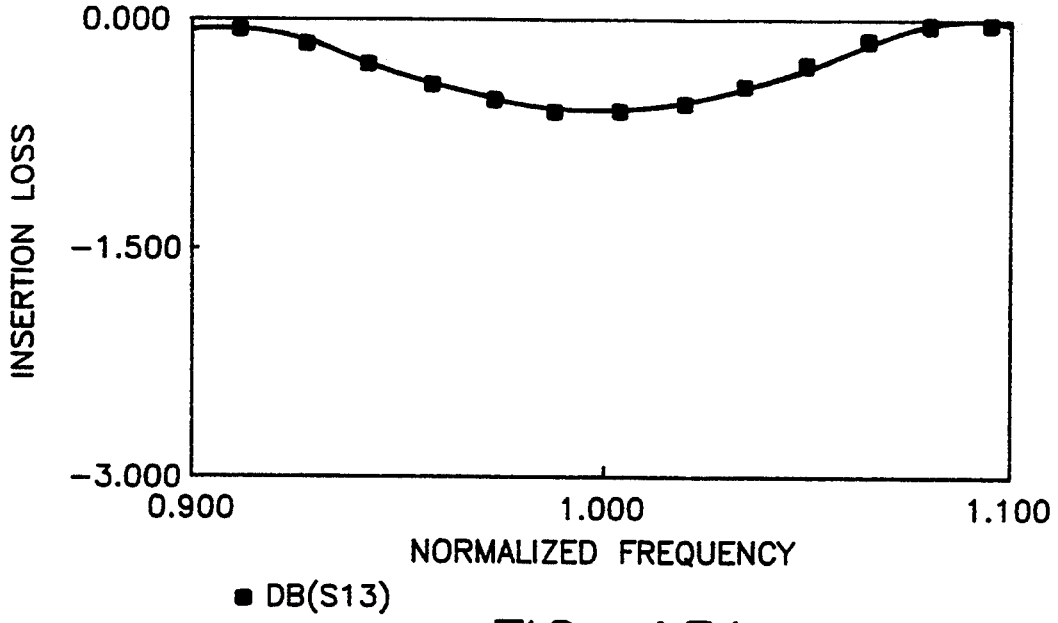
FIGS. 13A and 13B shows the performance of a circuit similar to FIG. 9, wherein the attenuation change with frequency is reduced.
Figure 13B:
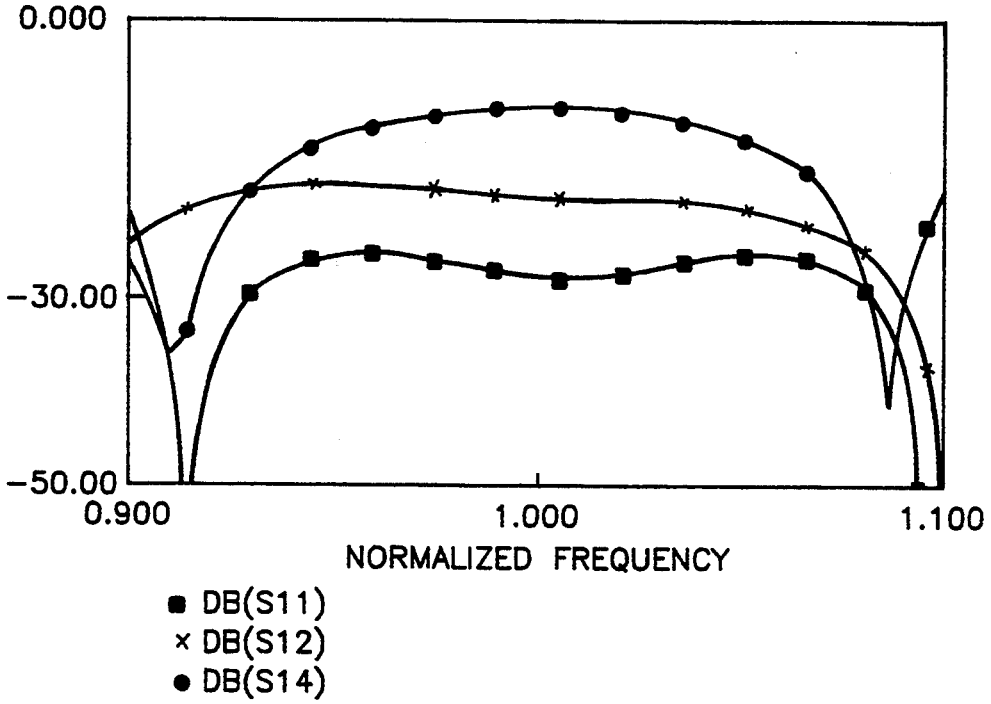

FIG. 13A and 13B shows the performance of a circuit similar to FIG. 9, wherein the attenuation variation is reduced.

While the equalizer circuits 30 and 40 which are the subject of the present invention are most useful as an interstage amplitude equalizer in high power amplifier circuits, they can be used in any situation where an equalizer circuit with low return loss is needed, especially in high power applications. An example is a waveguide loop directional coupler which is widely used in R.F. requiring directional injection or extraction of R.F. power. This type of coupler has an inherent frequency sensitivity of 6 dB per octave which produces an appreciable variation over even relatively narrow frequency bandwidths. The usual practice is to attach calibration charts to such couplers, so that accurate measurements can be made of the transmitted power and/or receiver sensitivity. The described microwave circuits 30 and 40 can be made a part of such loop couplers, producing constant coupling over the desired frequency band.

It will be understood that the embodiments descried herein are merely exemplary and that a person skilled in the art may make many variations and modifications to the described embodiments utilizing functionally equivalent elements to those described. While the aforementioned equalizer circuits 30 and 40 were fabricated in microstrip, the basic principle of varying the length of the cross arms can be applied to other RF transmission media including waveguides, and stripline and coaxial devices. In addition, the equalizer circuit which is the object of the present invention is not limited to a three or four cross-arm circuit, but also includes equalizer circuits having more than four cross-arms which can be used to increase bandwidth at the expense of longer insertion length. Any variations or modifications to the invention just described are intended to be included within the scope of said invention as defined by the appended claims.

We claim:

1. An equalizer circuit for RF frequencies having a minimum return loss, comprising:

a first branch line of a first given impedance having a first RF port and a second RF port, said first RF port being adapted for receiving input power to said equalizer circuit;

a second branch line of said first given impedance having a third RF port and a fourth RF port, said third RF port being adapted for providing power from said equalizer circuit;

a first cross arm of a first given electrical length and a second given impedance coupling said first branch line and said second branch line, said first cross arm being transverse to said first and second branch line;

a second cross arm of said first given electrical length and said second given impedance coupling said first and said second branch lines, said second arm being transverse to said first and said second branch lines; and a third cross arm of a second given electrical length and a third given impedance coupling said first and said second branch lines, said third cross arm being transverse to said first and said second branch lines, and being positioned symmetrically between said first and said second cross arms, said second electrical length differing from said first electrical length by substantially more than five degrees at any of said RF frequencies over which said equalizer circuit operates and said first, second, and third given impedance being unequal, thereby minimizing said return loss of said equalizing circuit, while providing a variable insertion loss as a function of said RF frequencies over which said equalizer circuit operates.

2. The equalizer circuit according to claim 1, wherein said equalizer circuit is fabricated as a microstrip device.

3. The equalizer circuit according to claim 1, wherein said equalizer circuit is fabricated as a stripline device.

4. The equalizer circuit according to claim 1, wherein said equalizer circuit is fabricated as a coaxial device.

5. The equalizer circuit according to claim 1, wherein said equalizer circuit is fabricated as a waveguide device.

6. The equalizer circuit according to claim 1, wherein said equalizer circuit has an insertion loss which increases with said RF frequencies over which said equalizer circuit operates.

7. The equalizer circuit according to claim 1, wherein said equalizer circuit has an insertion loss which decreases with said RF frequencies over which said equalizer circuit operates.

8. The equalizer circuit according to claim 1, wherein said equalizer circuit has a maximum insertion loss at a center bandwidth of said RF frequencies over which said equalizer circuit operates.

9. An equalizer circuit for RF frequencies having a minimum return loss, comprising:

a first branch line having three sections: a first section of a first given electrical length and a first given impedance having a first RF port and a first junction point, said first RF port being adapted for receiving input power to said equalizer circuit, a second section of said first given electrical length and said first given impedance having a second RF port and a second junction point, a third section of a second given electrical length and a second given impedance, joining the first said section and the said second section of said first branch line;

a second branch line having three sections: a first section of said first given electrical length and said first given impedance having a third RF port and a third junction point, said third RF port being adapted for providing power from said equalizer circuit, a second section of said first given electrical length and said first given impedance having a fourth RF port and a fourth junction point, a third section of said second given electrical length and said second given impedance, joining said first section and said second section of said second branch line;

a first cross arm of a third given electrical length and a third given impedance coupling said first port of said first branch line and said fourth port of said second branch line, said first cross arm being transverse to said first and second branch line;

a second cross arm of said third given electrical length and said third given impedance coupling said second port of said first branch line and said third port of said second branch lines, said second arm being transverse to said first and said second branch lines;

a third cross arm of a fourth given electrical length and a fourth given impedance coupling said first junction point of said first branch line and said fourth junction point of said second branch lines, said third cross arm being transverse to said first and said second branch lines;

a fourth cross arm of said fourth given electrical length and said fourth given impedance coupling said second junction point of said first branch line and said third junction point of said second branch lines, said fourth cross arm being transverse to said first and said second branch lines; and said first and second given electrical lengths being unequal, said third and fourth given electrical lengths being unequal, and said first, second, third, and fourth given impedance being unequal, thereby minimizing said return loss of said equalizing circuit, while providing a variable insertion loss as a function of said RF frequencies over which said equalizer circuit operates.

10. The equalizer circuit according to claim 9, wherein said equalizer circuit is fabricated as a microstrip device.

11. The equalizer circuit according to claim 9, wherein said equalizer circuit is fabricated as a stripline device.

12. The equalizer circuit according to claim 9, wherein said equalizer circuit is fabricated as a coaxial device.

13. The equalizer circuit according to claim 9, wherein said equalizer circuit is fabricated as a waveguide device.

14. The equalizer circuit according to claim 9, wherein said equalizer circuit has an insertion loss which increases with said RF frequencies over which said equalizer circuit operates.

15. The equalizer circuit according to claim 9, wherein said equalizer circuit has an insertion loss which decreases with said RF frequencies over which said equalizer circuit operates.

16. The equalizer circuit according to claim 9, wherein said equalizer circuit has a maximum insertion loss at a center bandwidth of said RF frequencies over which said equalizer circuit operates.

17. The equalizer circuit according to claim 1 wherein said first branch line has two sections: a first section of a third given electrical length and of said first given impedance having said first RF port and a first junction point, and a second section of said third given electrical length and said first given impedance having said second RF port;

said second branch line having two sections: a first section of said third given electrical length and of said first given impedance having said fourth RF port and a second junction point, and a second section of said third given electrical length and said first given impedance, having said third RF port;

said first cross arm coupling said first port of said first branch line and said fourth port of said second branch line;

said second cross arm coupling said second port of said first branch line and said third port of said second branch line;

said third cross arm coupling said first junction point of said first branch line and said second junction point of said second branch line; and said third given electrical length being different from said first given electrical length, and said third given electrical length being different from said second given electrical length.

* * * * *